US012078045B1

(12) United States Patent
Paulet

(10) Patent No.: US 12,078,045 B1
(45) Date of Patent: Sep. 3, 2024

(54) METHOD FOR COUNTING RESTRICTIONS IN A SUBTERRANEAN WELLBORE

(71) Applicant: Weatherford Technology Holdings, LLC, Houston, TX (US)

(72) Inventor: Bryan Paulet, Conroe, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/177,079

(22) Filed: Mar. 1, 2023

(51) Int. Cl.
*E21B 43/26* (2006.01)
*E21B 23/04* (2006.01)
*E21B 47/09* (2012.01)

(52) U.S. Cl.
CPC ..... *E21B 43/26* (2013.01); *E21B 23/0418* (2020.05); *E21B 47/09* (2013.01)

(58) Field of Classification Search
CPC ..... E21B 47/09; E21B 23/04; E21B 23/0418; E21B 43/26; E21B 43/2605; E21B 43/2607; E21B 43/27
See application file for complete search history.

(56) References Cited

U.S. PATENT DOCUMENTS 6,378,627 B1 * 4/2002 Tubel ..... E21B 17/1078 166/255.2
8,561,697 B2 10/2013 Strickland
9,328,578 B2 5/2016 Kumaran et al.
10,100,612 B2 10/2018 Lisowski et al.
10,240,448 B2 3/2019 Kuehl et al.
11,085,278 B2 8/2021 Akkerman et al.
2006/0230846 A1 * 10/2006 Smith ..... E21B 47/09 73/866.5
2010/0263856 A1 * 10/2010 Lynde ..... E21B 23/14 166/241.1
2011/0240301 A1 * 10/2011 Robison ..... E21B 43/14 166/334.1
2015/0218904 A1 8/2015 Chouffe
2016/0017704 A1 * 1/2016 Camwell ..... E21B 47/053 250/269.1
2016/0258259 A1 9/2016 Walton
2017/0254165 A1 9/2017 Coon
2018/0051554 A1 * 2/2018 Werkheiser ..... E21B 43/119
2019/0063214 A1 * 2/2019 Castillo ..... E21B 17/1057
2019/0071963 A1 * 3/2019 Sites ..... E21B 47/095
2020/0370421 A1 11/2020 Fripp et al.
2021/0156211 A1 5/2021 Arabskyy et al.
2021/0372271 A1 12/2021 Holly et al.
2022/0065058 A1 * 3/2022 Saeed ..... E21B 47/08
2022/0342006 A1 10/2022 Stolboushkin
2022/0389779 A1 12/2022 Jackson

FOREIGN PATENT DOCUMENTS

WO 2021173645 A1 9/2021

OTHER PUBLICATIONS

Jan. 16, 2024 International Search Report and Written Opinion of the ISA, PCT/US2023/075639, dated Jan. 16, 2024, 8 pgs.

* cited by examiner

*Primary Examiner* — Shane Bomar
(74) *Attorney, Agent, or Firm* — Peter V. Schroeder; Booth Albanesi Schroeder PLLC

(57) ABSTRACT

A tool counts the number of radial restrictions or seats in a series of frac valves along a completion string. At a preselected count, the tool radially expands a landing mechanism and lands on the next-reached frac valve.

17 Claims, 4 Drawing Sheets

METHOD FOR COUNTING RESTRICTIONS IN A SUBTERRANEAN WELLBORE

CROSS-REFERENCE TO RELATED APPLICATIONS

None.

TECHNICAL FIELD

The present disclosure relates to tools for use in operations in a subterranean wellbore, and more particularly, to a tool and methods of use for counting restrictions in a wellbore, such as those caused by seats in a series of frac sleeves or the like positioned in the wellbore.

BACKGROUND

After drilling through a formation to a predetermined length, it may be desirable to hydraulically fracture the formation to enhance future production. In a fracturing operation, a completion string is lowered into the wellbore. The completion string includes perforated tubulars allowing fracturing fluid to be pumped down the string, through the perforations, and into the formation. The high-pressure fluid causes fracturs in the surrounding formation. The completion string may be made up of blank tubing, packers, plugs and the like may be used on the completion string to isolate axial zones along the wellbore annulus.

Fracturing operations are often performed as a multi-stage fracturing operation. That is, a series of fracturing operations performed at multiple stages along the wellbore. To regulate which frac stage is run, the completion string comprises multiple frac valves or frac sleeves spaced along the string. The frac valves typically comprise a perforated tubular, with the perforations selectively blocked or opened by a valve member such as a sliding sleeve. A frac sleeve is typically run-in to the wellbore in a closed position, blocking flow from the completion string bore into the annulus surrounding the sleeve. To frac a selected stage, a corresponding frac sleeve is opened, allowing fluid flow into the annulus and fracture the formation. Opening a frac sleeve is often accomplished mechanically using an obstructing device, such as a ball, plug, dart or the like, which is dropped or pumped down the completion string bore until it lands on an internal seat or landing upset of the frac sleeve or an associated actuating tool. The landed obstructing device seals against flow through the sleeve bore and continued fluid pressure applied from above the sleeve forces the frac sleeve to open. When one stage has been fracked, another obstructing device is used to open the next frac sleeve to fracture a second stage. The obstructing devices are often removed after use, such as by dissolution, drilling or milling.

BRIEF DESCRIPTION OF THE DRAWINGS

Drawings of the preferred embodiments of the present disclosure are attached hereto so that the embodiments of the present disclosure may be better and more fully understood.

DETAILED DESCRIPTION OF EMBODIMENTS

Figure 1:
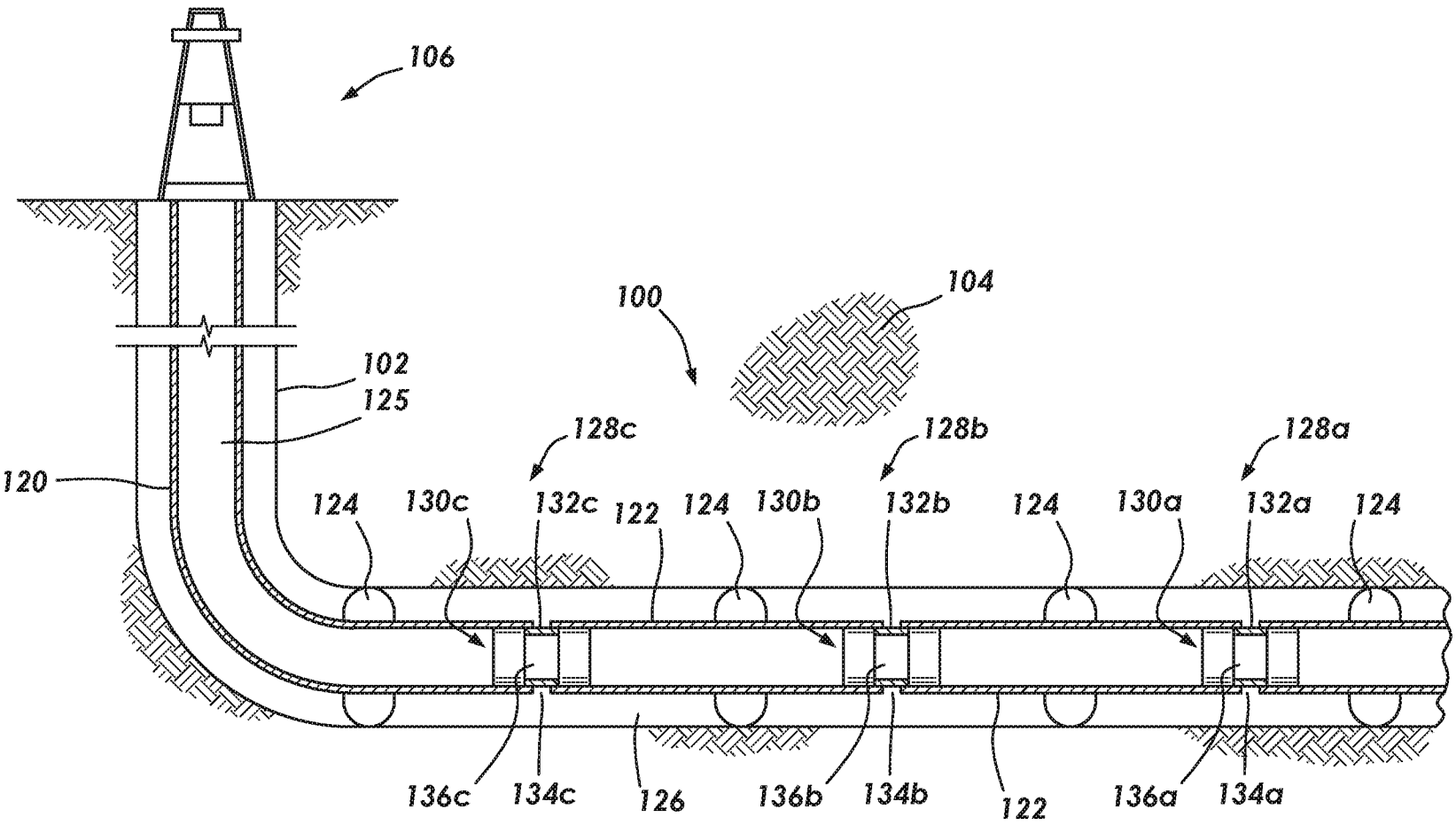
FIG. 1 is a cross-sectional, side elevation view of an exemplary well system having a wellbore extending through a subterranean formation with a completion string and multiple frac valves for operation in accordance with aspects of the disclosure.

During multi-stage fracturing operations, the wellbore is divided into stages, allowing fracturing of stages in sequence. The completion string employs a series of spaced apart frac valves, typically using sliding sleeves for opening the valves. The frac valves each define a radial restriction which serves as a seat or landing upset in or connected to the sliding sleeve. To fracture a selected stage, an actuation dart is pumped down the string. The actuation dart includes a counting subassembly for counting each radial restriction as the dart passes through a frac valve. The counter subassembly includes a plurality of mechanical arms for contacting the radial restriction as the dart moves through the valve. The mechanical arms collapse radially upon contact with a restriction, activating a switch or the like to send a signal to a controller within the dart. The controller counts the number of signals, corresponding to the number of restrictions passed. The controller is programmable to actuate the dart upon reaching a pre-selected number of signals.

Upon reaching the pre-selected number of signals, the controller then sends an actuation signal to an actuator which operates a radially expandable mechanism, such as a locking dog assembly or the like, such that the dart lands on the next frac valve seat encountered in the string. That is, the dart is sent downhole in a run-in position having a relatively smaller effective diameter. After clearing the last radial restriction before reaching the targeted valve, the dart expands to a relatively larger effective diameter sufficient to contact or lock onto the seat. Once the dart has landed on the selected seat, the valve is opened and fracturing of the corresponding stage is completed. Additional darts are sequentially run-in to the completion string to seat on additional valves, allowing sequential fracturing of the stages.

The embodiments herein are discussed, without limitation, in relation to a completion operation, and more specifically a staged fracturing operation. Persons of skill in the art will recognize that the apparatus and methods disclosed herein are equally applicable in similar operations requiring the counting of radial restrictions in a downhole tubular.

Similarly, the radial restrictions counted in the disclosure are defined on frac valves, although other types of actuatable downhole tools may also be used in the system. A typical frac valve utilizes a sliding sleeve to open flow through radial ports in the string. While reference is made in the exemplary embodiments to operation of sliding sleeves as the mechanical portion of the valve, person of skill in the art will recognize that other valves and valve actuation mechanisms may be utilized.

As used herein, a "radial restriction" of a valve member, frac valve, sliding sleeve and the like refers to seats, landings, upsets, or the like, as is known in the art, which provide a radial restriction for interaction with a downhole tool coming into contact with the seat. A seat and corresponding obstruction device, such as a drop ball, dart or the like, can form a fluidic seal against fluid flow past the seat.

FIG. 1 is a cross-sectional, side elevation view of an exemplary well system 100 having a wellbore 102 extending through a subterranean formation 104. The system 100 may include a rig 106 or pump station at the surface. A completion string 120 may be deployed into the wellbore 102. The completion string 120 is generally made up of tubulars strung together, and can include blank tubing 122, annular packers 124 or other wellbore isolation devices at spaced locations along the length of the wellbore, downhole tools and the like, as is known in the art. Fracking and other fluids can be pumped downhole through the interior bore 125 defined in the completion string 120 and its constituent members by a high-pressure pump, for example.

Annular packers 124 can be employed to seal off the annulus 126 between the completion string 120 and the wall of wellbore 102. The wellbore is thereby effectively divided into multiple stages 128*a*, 128*b*, and 128*c*, which may be stimulated or fracked independently. Three stages are shown, but more or fewer may be used. For purposes of this discussion, a fracturing operation is described, but persons of skill in the art will recognize that other similar operations can be run in stages using similar methods. Any number of stages can be defined in the system.

Each stage can include one or more frac valves 130, such as frac valves 130*a*, 130*b*, and 130*c*, which form part of the completion string 120. Each frac valve 130*a-c* has a sliding sleeve 132*a-c*, respectively, which is movable to open one or more radial ports 134*a-c*, respectively, to open flow between the interior of the completion string and the formation. Once open, the radial ports 134 allow fluid communication between the completion string bore 125 and the annulus 126. For example, pressurized fracturing fluid can be forced into the formation, creating fractures therein.

Each sliding sleeve 132*a-c* also includes a radial restriction 136*a-c*. The radial restrictions provide a landing or seat in the completion string for seating of a dart or other obstructing device, as explained herein. Further, the radial restriction 136*a-c* also acts as an actuating mechanism to open the frac valves 130*a-c*. To move a sliding sleeve 132*a-c* to an open position and open a corresponding port 134*a-c*, a dart is conveyed into the string 120. The dart travels through the bore of the string until it lands at a radial restriction of a selected valve. The dart may be pumped through the string 120 along with, for example, fracking fluids.

Figure 2C:
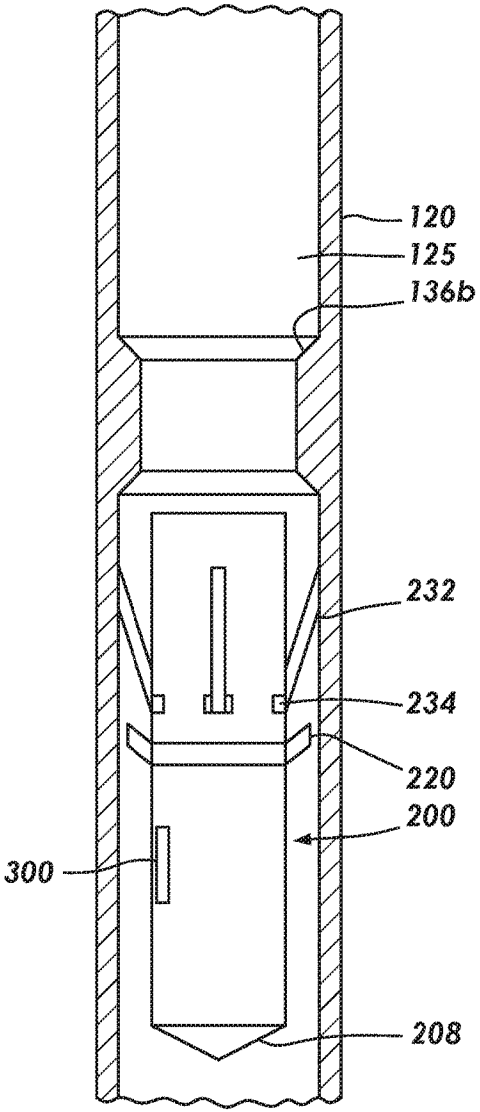
FIGS. 2A-C are elevational schematic views of an exemplary actuation dart according to aspects of the disclosure seen positioned in a completion string.
Figure 2B:
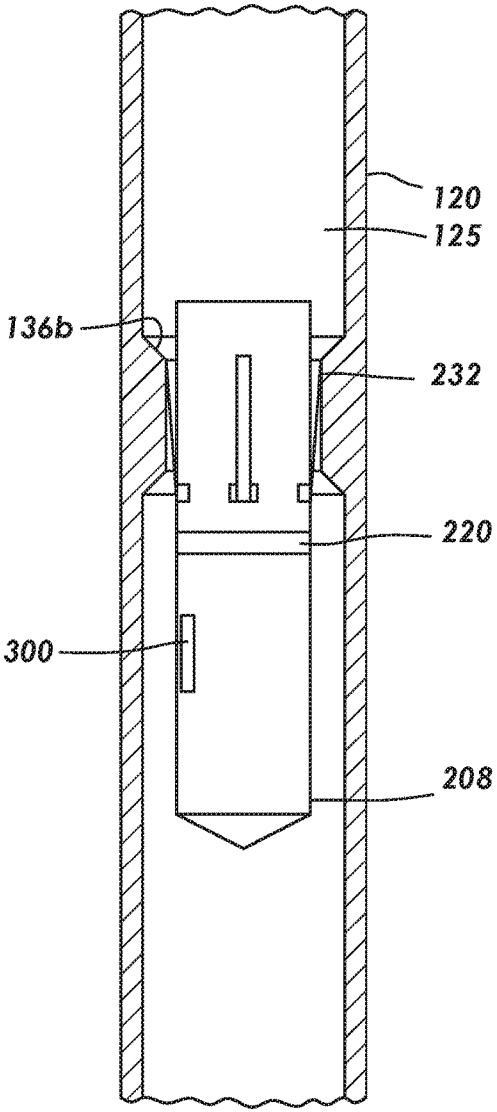
Figure 2A:
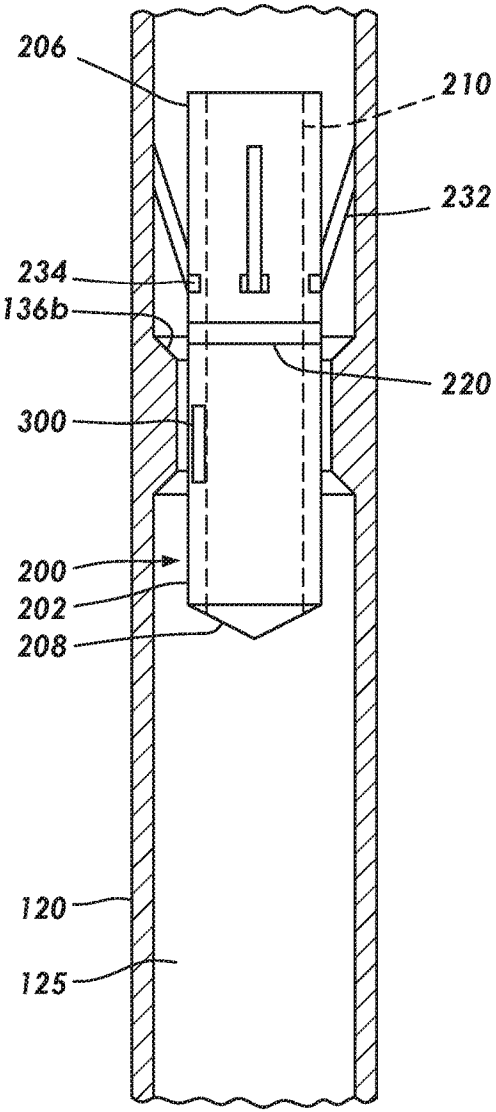

FIGS. 2A-C are elevational schematic views of an exemplary actuation dart 200 according to aspects of the disclosure. The actuation dart 200 can take various shapes, as desired, and can also act as a plug, frac plug, or the like. The use of the term "dart" is non-limiting with regards to the shape or size of the device, whether it is connected to additional downhole tools, lines or the like. The actuation dart 200 can be drillable, millable, dissolvable or otherwise removable from the wellbore after use.

The actuation dart 200 serves two functions, namely, to provide a method for counting the number of frac valves 130 through which the dart has passed along the completion string 120, and to land on a radial restriction 136 of a selected frac valve 130, thereby enabling operation of the valve. That is, the actuation dart 200 acts to count the number of radial restrictions defined by the seats 136 along the string 120. Upon reaching a pre-selected count, the actuation dart 200 then actuates a radially expandable landing mechanism 220 by radially expanding the mechanism such that it lands on the next seat 136 in the string 120.

The actuation dart 200 is conveyed into the bore 125 of the completion string 120 in a run-in configuration, as seen in FIG. 2A. The actuation dart 200 actuates into a set position, seen in FIG. 2C, prior to reaching a selected valve, say valve 130*a* and after passing through the previous, non-selected valves 130*b-c*, to land at the selected valve. That is, the actuation dart 200 is activated after passing through valve 130*b* and prior to reaching valve 130*a*.

The actuation dart 200 has a housing 202 having an uphole end 206 and a downhole end 208. The housing 202 may define a longitudinal fluid bore 210 therethrough. The bore allows fluid to flow through the actuation dart to avoid fluid pressure from building up when the actuation dart 200. The actuation dart 200 may also define an annular seat (not shown) in the bore 206 for cooperation with an obstruction device, such as a caged or temporarily retained ball, for selectively blocking flow through the bore.

The actuation dart 200 has a radially expandable landing structure 220 movable between a run-in position and a set position. In the run-in position the landing structure is radially collapsed, as seen in FIG. 2A, and does not land on the radial restriction 136 defined in the frac valve 130. In the set position, seen in FIG. 2C, the landing structure is in a radially expanded position and contacts, or lands on, the radial restriction 136. Radially expandable landing structures are known in the art and person of skill will recognize that such structures can be used on the actuation dart. For example, the radially expandable landing structure 220 can be a subassembly having a conical member and an expandable member which slide relative to one another, the conical member forcing the radially expandable member into the expanded state. For example, a conical or ramped member can force a set of flexible or movable arms, collet fingers, or the like, radially outward, then lock or radially support the structure in the set position. Alternately, the landing structure may utilize spring-loaded or otherwise biased latching member or members which automatically move to an expanded, set position when released. For example, a snap ring, snap collar, or spring-biased movable arms can radially expand upon release. Alternately, a landing structure can comprise locking dogs, as are known in the art. Release mechanism are also known in the art, such as shear pins, movable sleeves, latches, and the like. The landing structure can also lock into the set position in some embodiments, as is known in the art.

The radially expandable landing structure 220 in FIGS. 2A-C is shown schematically. The landing structure 220 is in a radially collapsed, run-in position in FIG. 2A, such that the landing structure does not interact with the radial restriction 136*b* of valve 130*b*. Rather, the actuation dart 200 simply travels past the restriction. In FIG. 2C, the landing structure is a radially expanded, set position, in which the landing structure 220 will catch on the next radial restriction, for example, restriction 136*a*. The landing structure 220 can include a latching mechanism, not shown, which cooperates with a corresponding mechanism defined on the radial restriction, as is known in the art. While the landing structure is shown in the Figures as closer to the front of the dart than the restriction sensing assembly 230, the landing assembly can be located elsewhere on the dart.

The actuation dart 200 also has a restriction sensing subassembly 230, as seen in FIGS. 2A-C. The restriction sensing subassembly 230 includes a plurality of mechanical, movable arms 232 which move between a radially expanded position, seen in FIG. 2A, and a radially collapsed position, as seen in FIG. 2B. The movable arms 232 are biased towards the expanded position, such that as the actuation dart 200 runs downhole, the arms are extended. For example, the arms can be biased by one or more springs towards the expanded position. For purposes of packaging, transport and placement of the tool in the completion string, it is possible in some embodiments to utilize a retention device to maintain the arms in the collapsed position until desired. Upon the actuation dart 200 passing a radial restriction 136*b*, the arms 232 contact the restriction as the arms in the expanded position have an effective diameter greater than that of the restriction. As the actuation dart 200 moves through the restriction, the arms 22 contact the restriction 136*b* and are forced inward to the collapsed position. Once the actuation dart 200 has moved past the restriction 136*b*, the arms are free to move to their original radially expanded position, as seen in FIG. 2C.

Operatively associated with each movable arm 232 is a corresponding sensor 234. The sensors 234 detect when the movable arms move to the collapsed position in response to contacting a radial restriction. The sensors 234 may be or include contact switches, limit switches, proximity switches, piezoelectric sensors, piezo-resistive sensors and the like, as are known in the art, and can operate using inductive, capacitive, optical, magnetic, or infrared mediums, for example. The sensors 234 are in communication, such as by wire, with a controller 240 and, upon activation by a movable arm 232 send a signal 242 to the controller.

Figure 3:
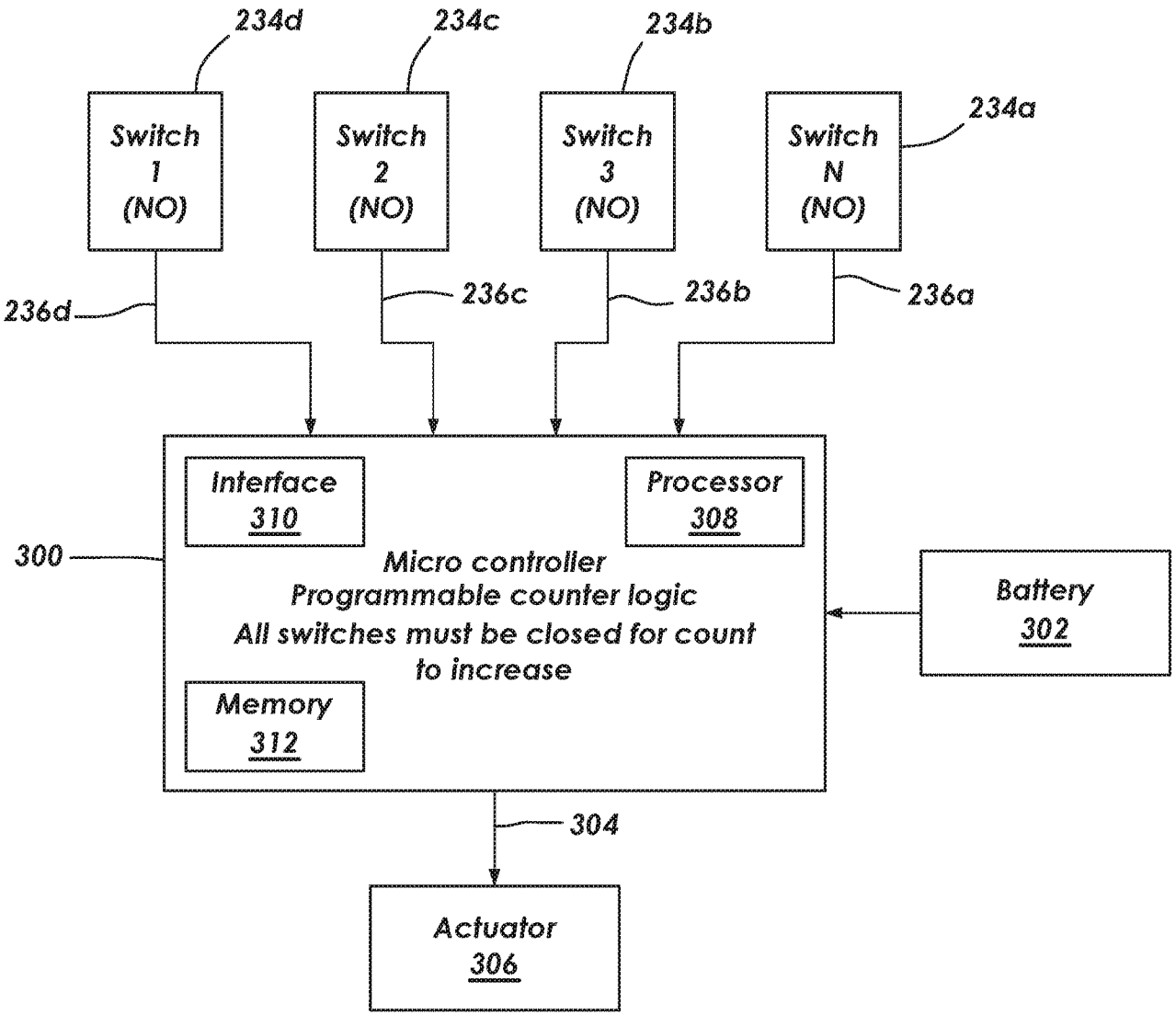
FIG. 3 is a schematic of exemplary circuitry for operating the actuation dart according to aspects of the disclosure.

The housing 202 also houses a controller 300, such as a control circuit, operatively connected to the sensors 234. FIG. 3 is a schematic of an exemplary circuit according to aspects of the disclosure. The plurality of sensors 234*a-d* are associated with respective movable arms 232 of the restriction sensing assembly. Each sensor 234*a-d* generates a sensor signal 236*a-d*, respectively, in response to the corresponding arm moving to the collapsed position. The sensor signal is communicated to the controller 300. A battery or power source 302 is provided to power the electronic components. The controller 300 is also operatively connected to an actuator 306. The controller 300 can include a processor 308 and memory 312 for performing logic, storing and updating data and the like, and operating the circuit, as well as a user interface 310. Settings may be configured via the interface 310, which provides a communication link between control circuit 114 and external devices. The interface 310 may be a wireless communication interface or a wired interface.

The memory 312 can be a processor-readable medium and store processor executable instructions, including activation code for actuating the actuator, which in turn actuates the radially expandable landing mechanism. The processor 308 can implement a method, discussed elsewhere. The memory 312 can store variables for use in the method, such as a count indicating the number of times the movable arms 232 moved to a collapsed position in response to contacting a radial restriction 136, and settings defining operational parameters, such as defining the number of the count to be reached before setting the landing mechanism 220.

The processor 308 is configured to receive sensor signals 236, based on the sensor signals received from sensors 234, a count in memory 312 or elsewhere. The count kept in the controller or associated processor and memory is indicative of the restrictions passed by the actuation dart. Thus, the controller 300 is configured to incrementally count in response to sensor signals 236. To prevent false counts, the controller is configured to only "count" when receiving sensor signals 236*a-d* from all of the sensors associated with the switches 234*a-d*. That is, a "count" is reached only when all of the movable arms are simultaneously moved to the collapsed position. This avoids "false" counts, where one or more movable arms 232 are moved to a collapsed position from contact with the interior of the completion string 120 or other tools which are part of the string. For this reason, the movable arms 232 are sized such that the actuation dart 200 cannot pass through a restriction 136 without collapsing all of the arms simultaneously. In an alternative embodiment, the sensors 234 can be electrically connected such that a single sensor signal 236 is sent only when all of the arms are collapsed simultaneously. That is, no signal is sent from an individual sensor to the controller unless and until all of the sensor arms are collapsed.

The controller 300 can generate an activation signal 304 to activate an actuator 306 when the count reaches the pre-selected value. The actuator 306 receives the activation signal and, in response, activates the actuation dart 200. To activate the actuation dart 200, the actuator 306 provides a force sufficient to move the radially expandable landing mechanism 220 from the run-in position to the expanded position, or sufficient to actuate a release mechanism, such as a shear member. For example, the actuator can move a conical sleeve in relation to a collet assembly, or move a mechanical member to shear a retention mechanism on spring-loaded landing mechanism members.

Actuators are known in the art and the selection depends on the type of action needed to set or radially expand the landing mechanism. The actuator can include an electric motor, a pressurized fluid, a linear or rotary actuator, etc.

Figure 4:
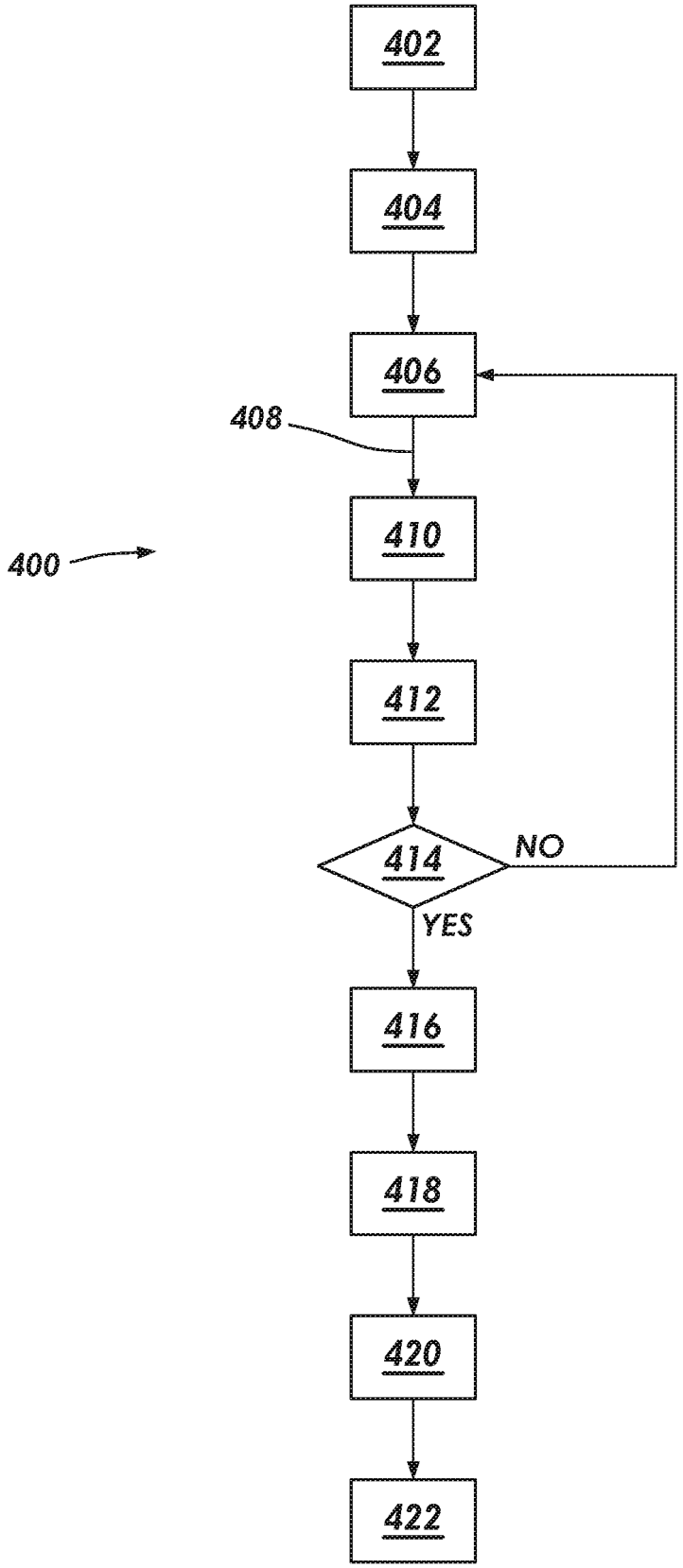
FIG. 4 is a flow chart of an exemplary method according to aspects of the disclosure.

FIG. 4 is a flow chart of an exemplary method 400 according to aspects of the disclosure. At 402, operational parameters of the actuation dart 200 are configured. For example, a target count or number can be input into the controller 300 indicating the number of sensor signals required prior to activation of the actuator and radial expansion of the landing mechanism. The parameters may be input via the interface 310, and the value may be stored in the memory 308.

At 404, the actuation dart 200 is placed in the wellbore, typically in the bore 125 of the completion string 120.

At 406, the actuation dart 200 is sent downhole. The wellbore can be vertical or horizontal, so the dart can be dropped or pumped down as needed. The completion string can be filled with a fluid, such as a fracking fluid to move the dart in the string.

At 408, the actuation dart travels through a portion of the completion string not having a radial restriction, such as through a blank tubing 122. The restriction sensor arms 232 are in the radially expanded position as they are not in contact with a radial restriction. It is possible that one or more of the sensor arms 232 moves to a collapsed position, even where no restriction is present. For example, the dart may travel along a horizontal wellbore such that any arms on the bottom of the dart as it travels are pushed, by weight of the dart against the completion tubing, to a collapsed position. In such as case, the collapsed arm will activate the corresponding sensor 234, which will send a sensor signal 236 to the controller 300. The controller 300, upon receiving the sensor signal 236 will not "count" a restriction, however, since it is programmed or operates to count only upon receiving signals from all of the sensors simultaneously.

At 410, the actuation dart 200 travels through a first radial restriction 136. The dart 200 passes through the restriction, such as a landing interior to a frac sleeve. As the dart 200 travels past the restriction, the radially expandable landing mechanism 220 is in the run-in position, as in FIG. 2A, and do not land on the restriction. The restriction sensing assembly 230 are moved, due to contact with the restriction, to the radially collapsed position as the arms 232 are moved radially inward.

At 412, the sensing assembly arms 232 activate switches 234*a-d* which send sensor signals 236*a-d* to the controller 300. The controller 300 reads the sensor signals, and as programmed, or in response to its circuitry, increases the "count" by one. (In an alternative embodiment, the sensors 234 are electrically connected such that a single sensor signal 236 is sent only when all of the arms are collapsed simultaneously.)

At 414, if the count does not equal the pre-selected value, the method returns to block 410 and the dart continues downhole. At 414, if the count equals the pre-selected value, then the method continues to 416 wherein the controller sends a signal to the actuator and the radially expandable landing mechanism is radially expanded. The radial expansion occurs after the actuation dart has passed through the current restriction.

At 418, the actuation dart lands on the next restriction reached by the dart. The expanded landing mechanism interacts with and seats on the radial restriction of the targeted frac valve. In some embodiments, the actuation dart plugs or blocks fluid flow along the completion string.

At 420, the actuation dart 200 is used to operate the target frac valve. For example, fluid pressure from above forces the now seated dart downward, thereby moving a sliding sleeve or the like in the frac valve and opening the radial ports. In some embodiments, this can require pumping down an obstructing device, such as a drop ball. In other embodiments, a sealing obstructing device is carried on the dart. In other embodiments, the actuation plug does not allow fluid flow therethrough, or does not allow flow therethrough downward.

At 422, the frac stage above the activated frac valve is fractured by pumping fracture fluid into the formation.

The dart may eventually be removed by drilling, milling, dissolving, or retrieval by pumping or retrieval tool.

In some embodiments, the actuation dart 200 operates autonomously, that is, without communication with other devices or the surface as it moves through the completion string.

As described herein, generally a tool is provided for sensing and counting a number of radial restrictions in a tubular extending along a wellbore. In some embodiments, a tool is provided for running along a tubular string extending through a subterranean formation, a plurality of radial restrictions spaced along the tubular string, the tool comprising: a tool body configured to travel within the tubular string; a plurality of mechanical arms extending radially outward from the tool body, each mechanical arm independently movable to a radially collapsed position when the mechanical arm contacts one of the plurality of radial restrictions, each mechanical arm biased to a radially extended position; a sensor system operable to generate a sensor signal in response to the mechanical arms moving to their collapsed positions; and a controller configured to receive the sensor signals, the controller configured to increase a count in response to receiving a sensor signal, the controller configured to generate an activation signal when the count reaches a pre-selected value. The tool disclosed above, wherein the sensor system comprises a plurality of sensors, each sensor corresponding to one of the plurality of mechanical arms. Any of the tools disclosed above, wherein either the sensor signal is sent only in response to all of the mechanical arms simultaneously being in the collapsed position, or wherein the controller only increases the count in response to receiving sensor signals simultaneously from each of the plurality of sensors. Any of the tools disclosed above, wherein the controller comprises a processor and a processor-readable medium, the processor-readable medium storing thereon processor-executable instructions, the processor-executable instructions, when executed by the processor, causing the processor to increase the count of received signals. Any of the tools disclosed above, wherein the tool further comprises a radially expandable landing mechanism, movable between a radially contracted position in which the tool is sized to move through the radial restrictions, and a radially expanded position in which the landing mechanism is sized to seat on a radial restriction. Any of the tools disclosed above, wherein the landing mechanism moves to the radially expanded position in response to receiving an activation signal from the controller. Any of the tools disclosed above, further comprising an actuator positioned in the tool for moving the landing mechanism to the radially expanded position in response to receiving the activation signal from the controller. Any of the tools disclosed above, wherein each of the plurality of mechanical arms is pivotally mounted on the tool body.

Various methods are disclosed herein which those of skill in the art will recognize can be practiced with varying numbers of steps, with the presented steps performed in various order, and performed skipping certain disclosed steps. In an exemplary method, the method comprises: running a tool through a tubular string positioned in a wellbore extending through a subterranean formation; running the tool sequentially through a plurality of radial restrictions defined in the tubular string; in response to running the tool through each of the radial restrictions, moving a plurality of arms movably mounted on the tool from radially expanded positions to radially collapsed positions; and determining, in response to movement of the arms to the collapsed positions, a count equal to the number of times the arms are moved to the radially collapsed positions, the count corresponding to the number of radial restrictions through which the tool has passed. The above disclosed method can further comprise: landing the tool on a radial restriction after the count reaches a pre-selected value. Any of the above disclosed methods can further comprise, wherein the radial restriction upon which the tool is landed is defined on a frac valve, and further comprising: opening the frac valve using the tool. Any of the above disclosed methods can further comprise, in response to the count reaching a pre-selected value, radially expanding a landing mechanism positioned on the tool. Any of the above disclosed methods can further comprise, sensing the movement of each of the arms to their respective collapsed positions; and in response to sensing the movement, sending a sensor signal to a controller. Any of the above disclosed methods can further comprise, determining the count until it reaches a pre-selected value; and further comprising, in response to reaching the pre-selected value, generating an activation signal from the controller. Any of the above disclosed methods can further comprise, receiving the activation signal at an actuator and, in response thereto, using the actuator to move a landing mechanism from a radially retracted run-in position to a radially expanded set position. Any of the above disclosed methods can further comprise, landing the tool on a radial restriction in response to moving the landing mechanism to the set position. Any of the above disclosed methods can further comprise, wherein the radial restriction upon which the tool is landed is defined on a frac valve, and further comprising: opening the frac valve using the landed tool. Any of the above disclosed methods can further comprise, fracturing the subterranean formation adjacent the frac valve. Any of the above disclosed methods can further comprise, running a second tool sequentially through the plurality of radial restrictions defined in the tubular string; in response to running the tool through each of the radial restrictions, moving a plurality of arms movably mounted on the second tool to radially collapsed positions;

and determining, in response to movement of the arms to the collapsed positions, a count equal to the number of times the arms are moved to the radially collapsed positions, the count corresponding to the number of radial restrictions through which the tool has passed. Any of the above disclosed methods can further comprise, landing the second tool on a radial restriction after the count reaches the pre-selected value less one The embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. A tool for running along a tubular string extending through a subterranean formation, a plurality of radial restrictions spaced along the tubular string, the tool comprising:

a tool body configured to travel within the tubular string;

a plurality of mechanical arms movable to extend radially outward from the tool body to an expanded position having an effective diameter greater than the plurality of radial restrictions, each mechanical arm independently movable to a collapsed position when the mechanical arm contacts one of the plurality of radial restrictions and wherein the mechanical arm moves to a collapsed diameter of less than the restriction diameter, each mechanical arm biased to the expanded position;

a sensor system operable to generate a sensor signal in response to one or more of the plurality of the mechanical arms moving in response to one or more of the plurality of radial restrictions;

a controller configured to receive the sensor signals, the controller configured to increase a count in response to receiving the sensor signal, the controller configured to generate an activation signal when the count reaches a pre-selected value; and a radially expandable landing mechanism, movable between a run-in position in which the landing mechanism defines a run-in diameter of less than the effective diameter of the plurality of radial restrictions and a radially expanded position in which the landing mechanism defines an expanded diameter of greater than the effective diameter of at least one of the plurality of radial restrictions.

2. The tool of claim 1, wherein the sensor system comprises a plurality of sensors, each sensor corresponding to one of the plurality of mechanical arms.

3. The tool of claim 2, wherein either the sensor signal is sent only in response to all of the mechanical arms simultaneously being in the collapsed position, or wherein the controller only increases the count in response to receiving sensor signals simultaneously from each of the plurality of sensors.

4. The tool of claim 3, wherein the controller comprises a processor and a processor-readable medium, the processor-readable medium storing thereon processor-executable instructions, the processor-executable instructions, when executed by the processor, causing the processor to increase the count of received signals.

5. The tool of claim 1, further comprising an actuator positioned in the tool for moving the landing mechanism to the radially expanded position in response to receiving the activation signal from the controller.

6. The tool of claim 1, wherein each of the plurality of mechanical arms is pivotally mounted on the tool body.

7. A method comprising:

running a tool through a tubular string positioned in a wellbore extending through a subterranean formation;

running the tool sequentially through a plurality of radial restrictions defined in the tubular string with a landing mechanism in a run-in position;

in response to running the tool through each of the radial restrictions, moving at least one of a plurality of arms movably mounted on the tool from a radially expanded positions to a radially collapsed positions; and determining a count equal to the number of times at least one of the plurality of the arms moves in response to one of the plurality of radial restrictions, the count corresponding to the number of radial restrictions through which the tool has passed; and in response to the count reaching a pre-selected value, expanding the landing mechanism from the run-in position to an expanded position having a diameter of greater than at least one of the radial restrictions.

8. The method of claim 7, further comprising: landing the tool on a radial restriction after the count reaches a pre-selected value.

9. The method of claim 8, wherein the radial restriction upon which the tool is landed is defined on a frac valve, and further comprising: opening the frac valve using the tool.

10. The method of claim 7, further comprising sensing the movement of each of the arms to their respective collapsed positions; and in response to sensing the movement, sending a sensor signal to a controller.

11. The method of claim 10, further comprising determining the count until it reaches a pre-selected value; and further comprising, in response to reaching the pre-selected value, generating an activation signal from the controller.

12. The method of claim 11, further comprising receiving the activation signal at an actuator and, in response thereto, using the actuator to move the landing mechanism from the radially retracted run-in position to the radially expanded set position.

13. The method of claim 12, further comprising landing the tool on a radial restriction in response to moving the landing mechanism to the set position.

14. The method of claim 13, wherein the radial restriction upon which the tool is landed is defined on a frac valve, and further comprising: opening the frac valve using the landed tool.

15. The method of claim 14, further comprising fracturing the subterranean formation adjacent the frac valve.

16. The method of claim 15, further comprising running a second tool sequentially through the plurality of radial restrictions defined in the tubular string;

in response to running the second tool through each of the radial restrictions, moving a plurality of arms movably mounted on the second tool to radially collapsed positions; and determining, in response to movement of the arms mounted on the second tool to the collapsed positions, a count equal to the number of times the arms mounted on the second tool are moved to the radially collapsed positions, the count corresponding to the number of radial restrictions through which the second tool has passed.

17. The method of claim 16, further comprising: landing the second tool on a radial restriction after the count reaches the pre-selected value less one.

* * * * *